US010429762B2

(12) United States Patent
Shao

(10) Patent No.: US 10,429,762 B2
(45) Date of Patent: Oct. 1, 2019

(54) METHOD AND DEVICE OF IMAGE FORMING TO REDUCE WASTE DEVELOPER

(71) Applicant: ZHUHAI SEINE TECHNOLOGY CO., LTD., Zhuhai (CN)

(72) Inventor: Zhe Shao, Zhuhai (CN)

(73) Assignee: ZHUHAI SEINE TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 16/048,551

(22) Filed: Jul. 30, 2018

(65) Prior Publication Data

US 2019/0041768 A1 Feb. 7, 2019

(30) Foreign Application Priority Data

Aug. 2, 2017 (CN) ..... 2017 1 0651760

(51) Int. Cl.

| | |
|---|---|
| ***G03G 15/06*** | (2006.01) |
| ***G03G 21/00*** | (2006.01) |
| ***G03G 15/02*** | (2006.01) |
| ***G03G 15/095*** | (2006.01) |
| ***G03G 15/00*** | (2006.01) |

(52) U.S. Cl.

CPC ..... *G03G 15/065* (2013.01); *G03G 21/0064* (2013.01); *G03G 15/0266* (2013.01); *G03G 15/095* (2013.01); *G03G 15/5004* (2013.01); *G03G 2221/0005* (2013.01)

(58) Field of Classification Search

None

See application file for complete search history.

(56) References Cited

U.S. PATENT DOCUMENTS

| | | | | |
|---|---|---|---|---|
| 6,081,679 A * | 6/2000 | Yamane | G03G 21/0064 | 399/100 |
| 6,785,485 B2 * | 8/2004 | Kamimura | G03G 15/0806 | 399/347 |
| 2010/0135685 A1 * | 6/2010 | Chang | G03G 15/065 | 399/55 |

* cited by examiner

*Primary Examiner* — Victor Verbitsky

(74) *Attorney, Agent, or Firm* — Anova Law Group, PLLC

(57) ABSTRACT

An image forming method includes when an image forming device is in a non-image-forming stage, applying voltages to a surface of a photosensitive element and a surface of a developer element of the image forming device to form an electric field. Applying the voltages includes: forming a first potential difference between the photosensitive element and the developer element in a first stage, and forming a second potential difference between the photosensitive element and the developer element in a second stage. When a developer used by the developer element is a negatively charged developer, a direction of the first potential difference and a direction of the second potential difference are in a direction from the developer element to the photosensitive element. When positively charged, the direction of the first potential difference and the direction of the second potential difference are in a direction from the photosensitive element to the developer element.

18 Claims, 6 Drawing Sheets

S101

When an image forming device is in a non-image-forming stage, applying voltages to a surface of a photosensitive element and a surface of a developer element of the image forming device to form an electric field, wherein applying the voltages comprises: forming a first potential difference between the photosensitive element and the developer element in a first stage, and forming a second potential difference between the photosensitive element and the developer element in a second stage.

FIG. 1

METHOD AND DEVICE OF IMAGE FORMING TO REDUCE WASTE DEVELOPER

CROSS-REFERENCES TO RELATED APPLICATIONS

This application claims the priority to Chinese Patent Application No. CN201710651760.2, filed on Aug. 2, 2017, the content of which is incorporated by reference in its entirety.

TECHNICAL FIELD

The present disclosure generally relates to the field of printing technology and, more particularly, to a method and a device of image forming.

BACKGROUND

As printing technology continuously develops, printing devices are more required to be economical efficiency and easy to use.

In the current printer design, after a printer at a standby status receives a printing command, a control chip drives the motor to operate the image forming unit according to a predetermined flow scheme. A voltage applying unit applies corresponding voltages to the charging roller, the developer roller, the transfer roller, and the photosensitive drum in the image forming unit, respectively. The image forming unit is used for completing image forming operation under different voltages applied by the voltage applying unit.

A typical control process for the image forming unit to receive a print command includes the following stages: a starting stage, a non-image-forming state, an image forming stage, and a standby stage. The starting stage mainly refers to a short time period when the motor starts to operate. In the starting stage, the voltages applied to the developer cartridge are changed frequently so that waste developer generated in the starting stage is reduced. The non-image-forming stage mainly refers to a process after the starting stage is completed, in which the paper has not reached or has left the image forming unit in the image forming device. In the non-image-forming stage, no image is formed on the paper. The image forming stage refers to the process when the paper is passing through the image forming unit or the paper is about to reach or leave the image forming unit. In the image forming stage, a printed image is generated on the paper.

Conventionally, when the image forming device is in a non-image-forming stage, the voltage applying unit applies a fixed voltage on each component in the cartridge, which includes a charging roller, a developer roller, a transfer roller, a photosensitive drum, etc. In this scenario, a large amount of the waste developer is produced in the image forming unit, which causes the waste of the developer. In addition, when the generated waste developer is too much, the developer may overflow the waste developer storage device in the image forming unit to contaminate the image forming device or the paper. Undesirable sensation experience may be brought to the users and the printing quality may be influenced.

SUMMARY

One aspect of the present disclosure provides an image forming method. The image forming method includes when an image forming device is in a non-image-forming stage, applying voltages to a surface of a photosensitive element and a surface of a developer element of the image forming device to form an electric field. Applying the voltages includes: forming a first potential difference between the photosensitive element and the developer element in a first stage, and forming a second potential difference between the photosensitive element and the developer element in a second stage. When a developer used by the developer element is a negatively charged developer, a direction of the first potential difference and a direction of the second potential difference are in a direction from the developer element to the photosensitive element. When the developer used by the developer element is a positively charged developer, the direction of the first potential difference and the direction of the second potential difference are in a direction from the photosensitive element to the developer element. An absolute value of the first potential difference is less than an absolute value of the second potential difference.

Another aspect of the present disclosure provides an image forming device. The image forming device includes a photosensitive element; and a developer element. In a non-image-forming stage, the photosensitive element and the developer element are configured to have an electric field there-between. In a first stage of the non-image-forming stage, a first potential difference is formed between the photosensitive element and the developer element. In a second stage of the non-image-forming stage, a second potential difference is formed between the photosensitive element and the developer element, and an absolute value of the first potential difference is less than an absolute value of the second potential difference. When the developer element uses a negatively charged developer, a direction of the first potential difference and a direction of the second potential difference are in a direction from the developer element to the photosensitive element. When the developer element uses a positively charged developer, the direction of the first potential difference and the direction of the second potential difference are in a direction from the photosensitive element to the developer element. The image forming device further includes a voltage applying unit, electrically connected to the developer element and configured to: continuously apply a first voltage to the developer element in the first stage of the non-image-forming stage, and continuously apply a second voltage to the developer element in the second stage of the non-image-forming stage. An absolute value of the first voltage is greater than an absolute value of the second voltage, and a polarity of the first voltage and a polarity of the second voltage are same as a polarity of a potential on the surface of the photosensitive element.

Another aspect of the present disclosure provides an image forming device. The image forming device includes a photosensitive element; a transfer element; and a developer element. In a non-image-forming stage, the photosensitive element and the developer element are configured to have an electric field there-between. In a first stage of the non-image-forming stage, a first potential difference is formed between the photosensitive element and the developer element. In a second stage of the non-image-forming stage, a second potential difference is formed between the photosensitive element and the developer element, and an absolute value of the first potential difference is less than an absolute value of the second potential difference. When the developer element uses a negatively charged developer, a direction of the first potential difference and a direction of the second potential difference are in a direction from the developer element to the photosensitive element. When the developer element uses a positively charged developer, the direction of the first potential difference and the direction of the second potential difference are in a direction from the photosensitive element to the developer element. The image forming device further includes a voltage applying unit, electrically connected to the transfer element and configured to: continuously apply a first voltage to the transfer element in the first stage of the non-image-forming stage, and continuously apply a second voltage to the transfer element in the second stage of the non-image-forming stage. An absolute value of the first voltage is greater than an absolute value of the second voltage, and a polarity of the first voltage and a polarity of the second voltage are opposite to a polarity of a potential on the surface of the photosensitive element.

Other aspects or embodiments of the present disclosure can be understood by those skilled in the art in light of the description, the claims, and the drawings of the present disclosure.

BRIEF DESCRIPTION OF THE DRAWINGS

In order to more clearly illustrate the technical solutions in the embodiments of the present disclosure or in the prior art, the accompanying drawings used in the description of the embodiments or the prior art are briefly introduced. The accompanying drawings in the following description are some embodiments of the present disclosure. It will be understood by those skilled in the art, that other drawings may be obtained according to the accompanying drawings without any creative efforts. The accompanying drawings are merely examples for illustrative purposes according to various disclosed embodiments and are not intended to limit the scope of the present disclosure.

FIG. 1 is a flow diagram of an image forming method according to disclosed embodiments of the present disclosure;

DETAILED DESCRIPTION

Figure 2:
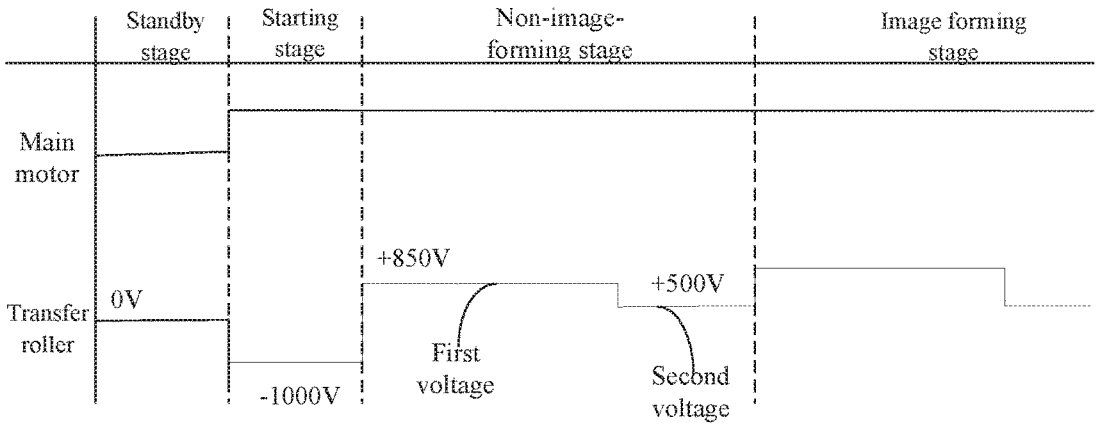
FIG. 2 is a schematic diagram of voltage change of a transfer roller of a printer in a first working state according to disclosed embodiments of the present disclosure.

To make the goal, the technical scheme, and the advantages of the embodiments of the disclosure clearer, reference will now be made in detail to exemplary embodiments of the disclosure, which are illustrated in the accompanying drawings. The embodiments described herein are just part of, rather than all of the embodiments of the present disclosure. Based on the embodiments of the present disclosure, all other embodiments obtained by persons of ordinary skill in the art without creative efforts belong to the protection scope of the disclosure.

FIG. 1 is a flow diagram of an image forming method according to disclosed embodiments of the present disclosure. As shown in FIG. 1, the image forming method provided by the disclosed embodiments may be mainly applied to devices, such as image forming devices. The method includes the following.

In S101: when the image forming device is in a non-image-forming stage, voltages are applied to the surface of the photosensitive element and the surface of the developer element of the image forming device to form an electric field there-between. The voltage applying process of the image forming device includes two stages.

In the first stage, a first potential difference is formed between the photosensitive element and the developer element. In the second stage, a second potential difference is formed between the photosensitive element and the developer element.

When the developer used by the image forming device is a negatively charged developer, a direction of the first potential difference and a direction of the second potential difference are in a direction from the developer element points to the photosensitive element. When the developer used by the image forming device is a positively charged developer, the direction of the first potential difference and the direction of the second potential difference are in a direction from the photosensitive element to the developer element;

The absolute value of the first potential difference is less than the absolute value of the second potential difference.

For example, when the image forming device is executing a printing process, based on operation conditions of printing parts and the status of printing paper in the printer, the printer may be in a standby stage, a starting stage, a non-image-forming stage, and an image forming stage. The starting stage of the image forming device refers to a short period after the main motor starts, in which the high voltage on the image forming unit in the image forming device changes frequently. In a non-image-forming stage, the printing paper has been transferring in the image forming device, but has not reached or has left the image forming unit in the image forming device. In the non-image-forming stage, the image is not generated on the printing paper. The image forming stage refers to the process when the printing paper is passing through the image forming unit or the printing paper is about to reach or leave the image forming unit. In the image forming stage, printing images starts being generated on the printing paper. In the process of generating images on the printing paper, appropriate voltages may be applied to each printing part to control the electric fields between different printing parts and transfer the developer with the static electricity between different printing parts, so that the image printing process may be completed.

When the image forming device is in a non-image-forming stage, the developer element in the printing part does not need to transfer the developer to the surface of the photosensitive element. But the surface of the developer element may be uniformly adhered with a certain amount of charged developer. Most of the developer may be normally charged when the developer on the developer element is electrified, and a small amount of developer can be unusually charged. That is, when the developer used by the image forming device is negatively charged developer, a large amount of developer is negatively charged and a small amount of developer is positively charged. When the developer used by the image forming device is positively charged developer, a large amount of developer is positively charged and a small amount of developer is negatively charged. For example, the developer used by the image forming device is positively charged developer, when the motor drives the image forming unit to rotate, normally charged developer on the surface of the developer element may be retained on the developer roller, while a small amount of negatively charged developer is easily transferred to the surface of the photosensitive drum and the waste developer is formed. In order to reduce the waste developer generated when the image forming device is in a non-image-forming stage, different voltages may be applied to the same printing part in the image forming unit in different time periods of this stage. As such, the potential difference between the developer roller and the photosensitive drum in the image forming unit is reduced, and the amount of unusually charged developer transferred to the surface of the photosensitive drum is reduced, so that the waste developer is reduced. When the image forming device is about entering the image forming stage, the voltage is switched to the voltage required for forming the image. For example, the non-image-forming stage can be divided into different time segments, and different voltages are applied to the same printing part in different time periods to meet different requirements of reducing the waste developer and ensuring the voltage in line with the requirements for the image forming stage, respectively. For example, the image forming device is a printer for illustration. When the non-image-forming stage is located before the image forming stage, voltages may be applied to the surface of the photosensitive element and the developer element of the printer in different time periods to form an electric field. And the voltage applying process includes two stages and the two stages are at different time periods in the non-image-forming stage.

For example, a first electric potential difference is formed between the photosensitive element and the developer element in the first stage, and a second electric potential difference is formed between the photosensitive element and the developer element in the second stage. The direction of the first potential difference and the direction of the second potential difference are related to the developing principles of the image forming method. When the developer used by the image forming device is a negatively charged developer, the direction of the first potential difference and the direction of the second potential difference are in a direction from the developer element to the photosensitive element. When the developer used by the image forming device is a positively charged developer, the direction of the first potential difference and the direction of the second potential difference are in the direction from the photosensitive element to the developer element. The direction of the potential difference is in the direction from the higher potential to the lower potential. The absolute values of the first potential difference and the second potential difference are different, and the absolute value of the first potential difference is less than the absolute value of the second potential difference. Thus, when the developer used by the image forming device is a negatively charged developer, the direction of the first potential difference and the direction of the second potential difference are in the direction from the developer element to the photosensitive element, so that a large amount of the developer with negative charges under the influence of the electric field will not be transferred to the surface of the photosensitive element and be retained on the surface of the developer element. Only small portion of the small amount of the positively charged developer or impurity may be transferred to the surface of the photosensitive element because a first potential difference which has an absolute value less than that of the second potential difference exists. Similarly, when the developer used by the image forming device is a positively charged developer, a large amount of positive charges are also retained on the surface of the developer element, and a small amount of the negatively charged developer or impurity is transferred to the surface of the photosensitive element. Therefore, cleaning the surface of the photosensitive element in the non-image-forming stage may generate less waste developer. Thus, when a first potential difference is applied between the photosensitive element and the developer element, the potential difference between a developer element of the printing parts such as a developer roller and a photosensitive element of the printing parts such as a photosensitive drum is decreased, so that the amount of the unusually charged developer transferred from the surface of the developer roller to the surface of the photosensitive drum may also be reduced. As such, the waste developer may be effectively reduced.

In other time periods of the non-image-forming stage, i.e., the second stage, by changing the voltages applied to the printing parts, a second potential difference is formed between the photosensitive element and the developer element. The absolute value of the second potential difference is larger. When the image forming device enters the image forming stage after voltages are applied to the developer element and the photosensitive element of the image forming device so that a second electric potential difference with a larger absolute value is formed between the photosensitive element and the developer element, since there exists the second potential difference which has a relative larger absolute value respect to the first potential difference, the voltage applied to the photosensitive element may be closer to the voltage of the photosensitive element in the image forming stage. Thus, it is prevented that when the image forming device enters the image forming stage, after the surface of the photosensitive element is exposed, the potential difference between the surface of the exposure region of the photosensitive element and the developer element is large, so that a large amount of normally charged developer on the surface of the developer element is transferred to the surface of the photosensitive element. As a result, the printed image is deflection black in whole and poor in image quality.

After the image forming device completes the image forming stage, voltages are applied to the photosensitive element and the developer element of the image forming device to form the second potential difference between the photosensitive element and the developer element. After the photosensitive element operates for one circle, voltages are applied to form the first potential difference, which has a smaller absolute value respect to the second potential difference, between the photosensitive element and the developer element. Thus, the transfer of the unusually charged developer from the surface of the developer element to the surface of the photosensitive element is reduced so that the generation of waste developer is reduced.

In this way, within a certain period of time in the non-image-forming stage of the image forming device such as a printer, voltages are applied to the surface of the photosensitive element and the surface of the developer element of the image forming device to form an electric field. The voltage applying process includes two stages with different potential differences, so that the potential difference between the developer element and the photosensitive element, for example, the potential difference between the developer roller and the photosensitive drum, may be reduced. Thus, the amount of developer transferred from the surface of the developer roller to the surface of the photosensitive drum may be reduced. Therefore, the waste developer generated when the image forming device is in a non-image-forming stage is reduced and the waste of the developer is effectively reduced. As such, the problem that the image forming device or the paper will be contaminated when the waste developer generated in the image forming unit is too much to overflow the waste developer storage device of the image forming unit may be avoided.

Printing parts in a printer includes a plurality of elements such as a photosensitive drum, a developer roller, and a transfer roller, etc. A first voltage or a second voltage with the same polarity but a different absolute value may be applied to the same printing part during different time periods in the non-image-forming stage, so that the potential difference between the photosensitive drum and the developer roller can be effectively reduced and the generation of waste developer is reduced. Thus, the printing part in different time periods, for example, the first stage and the second stage may have different potential differences with respect to other printing parts, i.e., a first potential difference and a second potential difference. Therefore, different voltages are applied during different time periods, so that a small electric potential difference can be provided between the developer element and the photosensitive element in the non-image-forming stage. As such, the developer with charges is prevented from being attracted to the surface of the photosensitive element due to a large potential difference, and the amount of developer is reduced.

In order to form the first potential difference and the second potential difference with a different absolute value between the developer element and the photosensitive element, the method of applying voltages to the surface of the photosensitive element and the surface of the developer element of the image forming device to form the electric field may include the following.

In the first stage, a first voltage is applied to the transfer element. In a second stage, a second voltage is applied to the transfer element. The absolute value of the first voltage is larger than the absolute value of the second voltage, and the polarity of the first voltage and the polarity of the second voltage are opposite to the polarity of the electric potential of the surface of the photosensitive element.

Thus, different voltages can be applied to the transfer elements, such as the transfer roller, to form the first electric potential difference or the second electric potential difference on the surface of the photosensitive element and the surface of the developer element. In addition, the first voltage or the second voltage may also be applied on the developer element to form the first electric potential difference or the second electric potential difference.

For example, in order to ensure that the printer has a great printing quality in the image forming stage, the duration of applying the second voltage may be greater than or equal to the time period for the photosensitive drum to rotate by one circle in the non-image-forming stage. Thus, the surface of the photosensitive drum can be ensured to be uniformly charged by the charging roller and the formation of the image is ensured to be complete normally.

In order to ensure that when the printer is about to print or almost finished printing, a second potential difference is formed between the developer element and the photosensitive element. In other words, when the image forming device is in the second stage, the stage of continuously having the second potential difference is adjacent to the image forming stage of the printer, that is, right after the voltages are applied on the printing parts to form the second electric potential difference between the developer element and the photosensitive element, the printer enters the image forming stage, or after the image forming stage, the voltages are applied immediately to form the second electric potential difference.

Entering the image forming stage after the second potential difference is formed between the developer element and the photosensitive element may ensure that when the printer is about to enter the image forming stage, voltages which may reduce the potential difference between the photosensitive drum and the transfer roller are applied to the printing part of the printer, so that the potential of the photosensitive element may be closer to the voltage status of the photosensitive element in the image forming stage. The image forming device may be prevented from when entering an image forming stage, after the surface of the photosensitive element is exposed, the potential difference between the surface of the exposed region of the photosensitive element and the developer element is large, which may cause a large amount of normally charged developer on the surface of the developer element to be transferred to the surface of the photosensitive element and the printed image is deflection black in whole and poor in image quality. In an exemplary embodiment, when the image forming device is in image forming stage, the potential difference formed between the photosensitive element and the developer element may be equal to the second potential difference.

Alternatively, when the printer has just finished the image forming stage, the voltage applied by the voltage applying unit on the printing part is large. At this moment, the voltage applied by the voltage applying unit to the charging roller does not change. In an environment with a low-temperature and a low-humidity, when the image forming device is in an image forming stage, the effect of the voltage applied by the voltage applying unit to the surface of the photosensitive drum has not been eliminated and the absolute value of the potential of the surface of the photosensitive drum is less than the absolute value of the potential of the developer roller, so that A large amount of normally charged developer on the developer roller is transferred to the photosensitive drum to form waste developer. In order to avoid this scenario, in the non-image-forming stage right after the printer completes the image forming stage, the second voltage with a smaller absolute value can be applied to the printing part, and after the photosensitive drum operates one circle, the first voltage with a greater absolute value is applied. Therefore the potential difference between the photosensitive drum and the developer roller is reduced and the amount of the unusually charged developer being transferred from the surface of the developer roller to the surface of the photosensitive drum is reduced, so that the generation of waste developer is reduced.

Based on different working stages of the printer, the non-image-forming stage may be located before the image forming stage and adjacent to the image forming stage so that printing may be carried out by using the printer.

The non-image-forming stage may be located after the image forming stage so that the printer is ready to enter standby mode after the printer finishes printing.

The non-image-forming stage may be located between two adjacent image forming stages. According to the different positions of the non-image-forming stages, the timings of the first stage and the second stage in the non-image-forming stage may also be different.

When the printer is in the image forming stage, based on different tasks, the non-image-forming stage and the image forming stage usually have different arrangement orders. For illustration purpose, the transfer element in the printing parts is taken as an example and the voltages applied on the transfer element in different stages are described.

FIG. 2 is a schematic diagram of voltage change of a transfer roller of a printer in a first working state according to the embodiments of the present disclosure. As shown in FIG. 2, when the non-image-forming stage is located before the image forming stage of the printer, the printer in the non-image-forming stage does not start printing. Applying voltages to the surface of the photosensitive element and the surface of the developer element of the image forming device to form an electric field includes the following:

When the non-image-forming stage includes one second stage, forming the first electric potential difference in the first stage is earlier than forming the second electric potential difference in the second stage, and after the second stage, the image forming device is in the image forming stage. In the first stage, a first voltage is applied to the transfer element. In the second stage, a second voltage is applied to the transfer element. The absolute value of the first voltage is greater than the absolute value of the second voltage, and the polarity of the first voltage and the polarity of the second voltage are opposite to the polarity of the electric potential of the surface of the photosensitive element.

The first voltage may be +850V and the second voltage may be +500V. The polarity of the first voltage and the polarity of the second voltage are the same, and the absolute value of the first voltage is greater than the absolute value of the second voltage. Both the first voltage and the second voltage are applied to the transfer part, i.e., the transfer roller. The polarity of the first voltage and the polarity of the second voltage are opposite to the polarity of the potential of the surface of the photosensitive element such as the photosensitive drum. In the non-image-forming stage, a first voltage with higher absolute value (+850V) may be continuously applied to the transfer roller. When the developer used by the image forming device is a negatively charged developer and the first voltage (+850V) is applied to the transfer roller, the direction of the first potential difference between the developer element and the photosensitive element is in a direction from the developer element to the photosensitive element. Thus, a large amount of the developer with negative charges in the electric field will not be transferred to the surface of the photosensitive element and is retained on the surface of the developer element. Only a small portion of the small amount of the positively charged developer or impurity may be transferred to the surface of the photosensitive element because a first potential difference which has an absolute value less than that of the second potential difference exists. Similarly, when the developer used by the image forming device is a positively charged developer and the first voltage (+850V) is applied to the transfer roller, the direction of the first potential difference between the developer element and the photosensitive element is in a direction from the photosensitive element to the developer element. A large amount of positively charged developer are also retained on the surface of the developer element, and a small amount of the negatively charged developer or impurity is transferred to the surface of the photosensitive element. Therefore, cleaning the surface of the photosensitive element in the non-image-forming stage may generate less waste developer. The potential difference between the developer roller and the photosensitive drum is reduced in a period of applying the first voltage (at the same time, the voltage on the developer roller may be up to about −300V), so as to reduce the attraction and transfer of the unusually charged developer on the photosensitive drum and reduce the generation of waste developer. When the printer is about to enter the image forming stage, the voltage applied to the transfer roller can be switched into the second voltage, which has the same polarity with the first voltage, while the absolute value of the second voltage is less than the first voltage (+500V). In the image forming stage, due to the presence of the second potential difference with a larger absolute value (respect to the first potential difference), the potential of the photosensitive element may be closer to the voltage status of the photosensitive element in the image forming stage. Thus, it can be prevented that when the image forming device enters the image forming stage, after the surface of the photosensitive element is exposed, the potential difference between the surface of the exposure region of the photosensitive element and the developer element is large, so that a large amount of normally charged developer on the surface of the developer element is transferred to the surface of the photosensitive element, and the printed image is deflection black as a whole and the image quality is poor. As such, the image forming device such as a printer can have a good image effect in the image forming stage.

Figure 3:
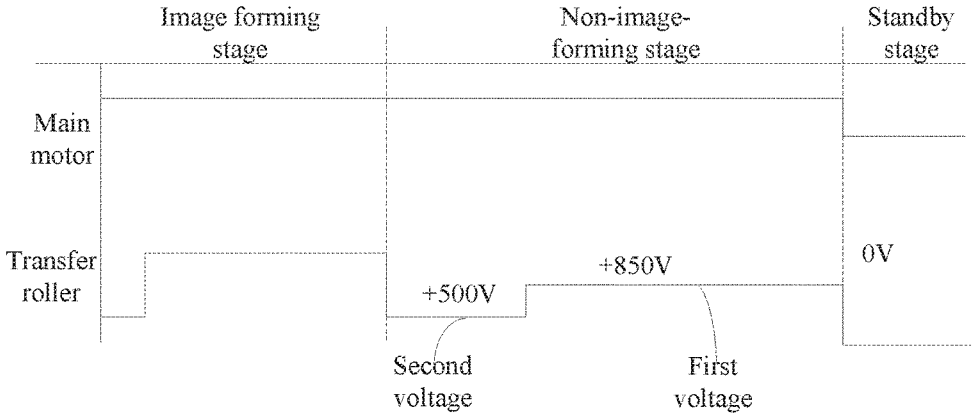
FIG. 3 is a schematic diagram of voltage change of a transfer roller of a printer in a second working state according to disclosed embodiments of the present disclosure.

FIG. 3 is a schematic diagram of voltage change of a transfer roller in a printer in a second working state according to embodiments of the present disclosure. As shown, when the printer finishes image printing and enters the standby state, an image forming stage and a non-image-forming stage still exist. The non-image-forming stage is located after the image forming stage of the printer. Continuously applying a first voltage or a second voltage to the transfer roller in different time periods in the non-image-forming stage includes: applying the second voltage in a second stage, so that forming a second potential difference is earlier than forming a first potential difference by applying the first voltage in the first stage. The image forming device is in image forming stage before the second stage.

For example, after the image forming stage is finished, the printer will enter the non-image-forming stage, and a second voltage (+500V) with a smaller absolute value is applied to the printing parts such as the transfer roller and lasts for a certain period of time, that is, the second stage. Thus, it may be prevented that in an environment with a low-temperature and a low-humidity, when the image forming device is in an image forming stage, the effect of the voltage applied by the voltage applying unit to the surface of the photosensitive drum has not been eliminated and the absolute value of the potential of the surface of the photosensitive drum is less than the absolute value of the potential of the developer roller, so that a large amount of normally charged developer on the developer roller is transferred to the photosensitive drum to form waste developer. And after the second stage, the voltage applied to the transfer roller changes to the first voltage (+850V), so that the potential difference between the photosensitive drum and the developer roller is reduced and the amount of the unusually charged developer being transferred from the surface of the developer roller to the surface of the photosensitive drum is reduced, so that the generation of waste developer is reduced.

In addition, there may be a third alternative embodiment. When the printer is in the double-sided printing mode, between the front printing process and the back printing process of the printing paper, the main motor of the printer does not stop, that is, the period between two image forming stages of the front side image printing and the back side image printing is a non-image-forming stage. Thus, the non-image-forming stage includes two second stages. A time point of forming the first potential difference in the first stage is between a time point of forming the second potential difference in a first second-stage and a time point of forming the second potential difference in a second second-stage, and after the second second-stage, the image forming device is in an image forming stage.

Figure 4:
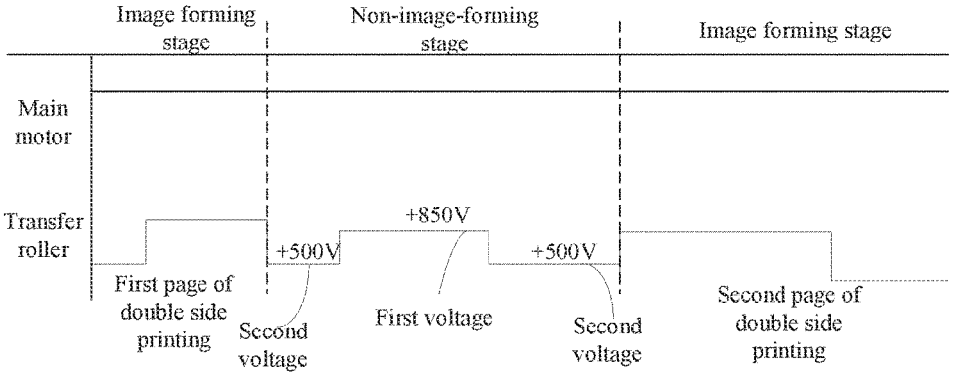
FIG. 4 is a schematic diagram of voltage change of a transfer roller of a printer in a third working state according to disclosed embodiments of the present disclosure.

FIG. 4 is a schematic diagram of voltage change of a transfer roller in a printer in a third working state according to embodiments of the present disclosure. As shown in FIG. 4, a non-image-forming stage is located between the two image forming stages, and the different time period s in the non-image-forming stage are respectively in sequence: the second stage, a first stage, and a second stage. The starting point and ending point of the several stages may be connected, that is, the ending time of the first stage is the starting time of the first stage and the ending time of the first stage is the starting time of the second stage.

For example, voltages applied on the transfer roller in the three continuous time periods in the non-image-forming stage is firstly a second voltage, and the second voltage lasts for a period of time, i.e., the first second-stage. The voltage is switched to a second voltage after the first stage, and is continuously applied until the printer is entering the image forming stage again. Accordingly, when a first voltage with a greater absolute value is applied to the transfer roller, the potential difference between the developer roller and the photosensitive drum may be reduced. When the developer used by the image forming device is a negatively charged developer and a first voltage is applied to the transfer roller, the direction of the first potential difference between the developer element and the photosensitive element is in a direction from the developer element to the photosensitive element. Thus, a large amount of the developer with negative charges in the electric field will not be transferred to the surface of the photosensitive element and is retained on the surface of the developer element. Only a small portion of the small amount of the positively charged developer or impurity may be transferred to the surface of the photosensitive element because a first potential difference which has an absolute value less than that of the second potential difference exists. Similarly, when the developer used by the image forming device is a positively charged developer and the first voltage is applied to the transfer roller, the direction of the first potential difference between the developer element and the photosensitive element is in a direction from the photosensitive element to the developer element. A large amount of positively charged developer are also retained on the surface of the developer element, and a small amount of the negatively charged developer or impurity is transferred to the surface of the photosensitive element. Therefore, cleaning the surface of the photosensitive element in the non-image-forming stage may generate less waste developer. When the voltage applied to the transfer roller is the first voltage or the second voltage, the variation of the electric potential difference between the printing parts in the image forming device is described in detail in the previous introduced two working states, and the description will not be repeated herein.

In this embodiment, the image forming method includes when the image forming device is in a non-image-forming stage, applying a voltage to the surface of the photosensitive element and the surface of the developer element of the image forming device to form an electric field. The applying of voltage of the image forming device includes two stages. In a first stage, a first potential difference is formed between the photosensitive element and the developer element. In a second stage, a second potential difference is formed between the photosensitive element and the developer element. When the developer used by the image forming device is a negatively charged developer, the direction of the first potential difference and the direction of the second potential difference are in a directions from the developer element pointing to the photosensitive element. When the developer used by the image forming device is a positively charged developer, the direction of the first potential difference and the direction of the second potential difference are in a direction from the photosensitive element to the developer element. The absolute value of the first potential difference is less than the absolute value of the second potential difference. In this way, when the image forming device is in a non-image-forming stage, the potential difference between the photosensitive element and the developer element may be reduced. Thus, the amount of unusually charged developer transferred from the surface of the developer element, such as a developer roller, to the surface of a photosensitive element, such as a photosensitive drum, is reduced. As such, the waste of the developer generated when the image forming device is in the non-image-forming stage is reduced so that the waste of the developer is effectively reduced. Therefore, the problem may be avoided that the image forming device or the paper will be contaminated when the waste developer generated in the image forming unit is too much to overflow the waste developer storage device of the image forming unit.

Embodiment 2

Figure 5:
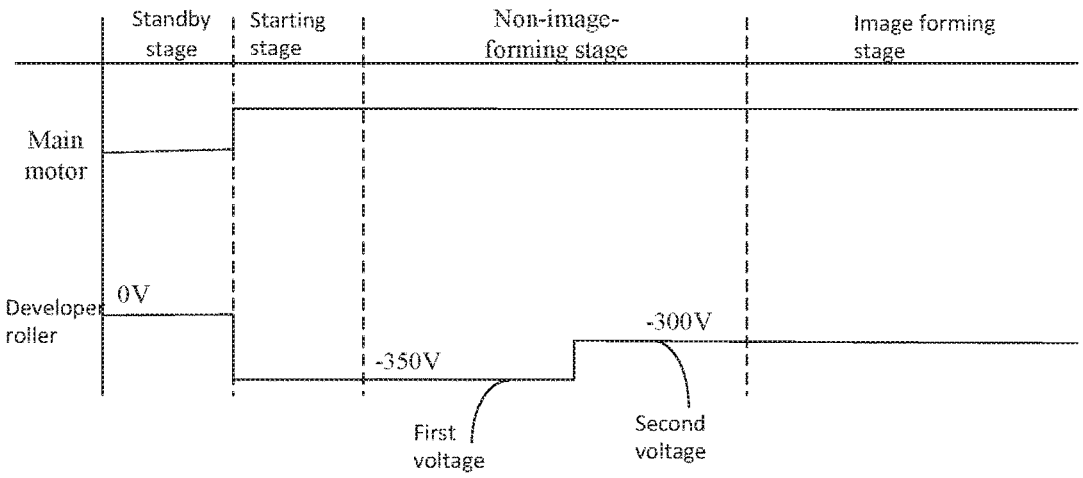
FIG. 5 is a schematic diagram of voltage change of a developer roller in a printer under a first working state according to disclosed embodiments of the present disclosure.
Figure 6:
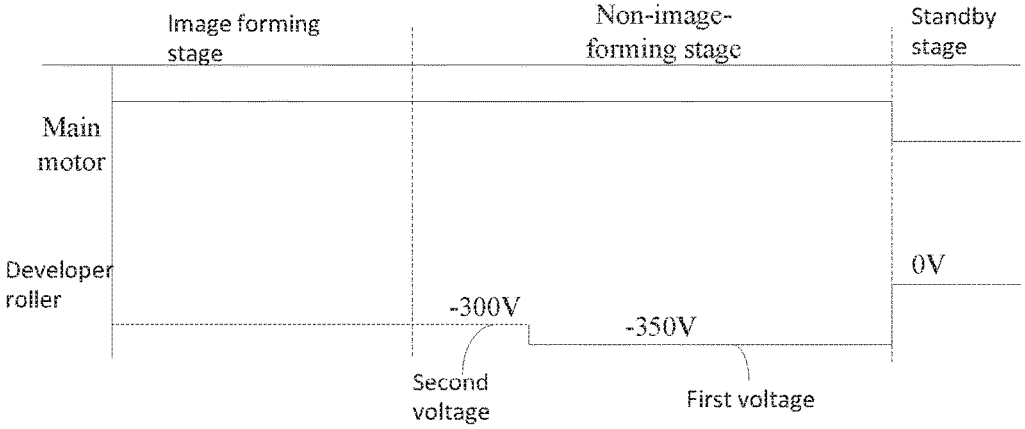
FIG. 6 is a schematic diagram of voltage change of a developer roller in a printer in a second working state according to disclosed embodiments of the present disclosure.
Figure 7:
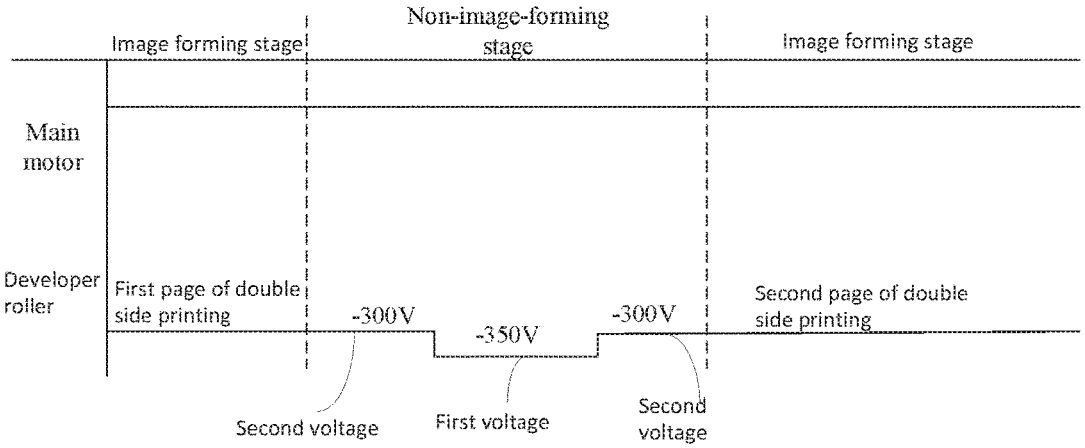
FIG. 7 is a schematic diagram of voltage change of a developer roller in a printer in a third working state according to disclosed embodiments of the present disclosure.

In addition, due to the fact that the printing parts of the image forming device includes not only the transfer roller, but also other parts, such as the developer roller. Thus, when the image forming device is in a non-image-forming stage, a first voltage and a second voltage with a different absolute value are applied to other printing parts, such as the developer roller, so that a first potential difference may be formed between the photosensitive element and the developer element in a first stage and a second potential difference is formed in the second stage to reduce the generation of the waste developer. For example, applying voltages to the surface of the photosensitive element and the surface of the developer element of the image forming device to form an electric field includes: in the first stage, a first voltage is applied to the developer element. In a second stage, a second voltage is applied to the developer element. The absolute value of the first voltage is greater than the absolute value of the second voltage, and the polarity of the first voltage and the polarity of the second voltage are same as the polarity of electric potential of the surface of the photosensitive element A printer is still taken as an example. FIG. 5 is a schematic diagram of voltage change of a developer roller in a printer in a first working state according to embodiments of the present disclosure. FIG. 6 is a schematic diagram of voltage change of a developer roller in a printer in a second working state according to embodiments of the present disclosure. FIG. 7 is a schematic diagram of voltage change of a developer roller in a third working state of a printer according to embodiments of the present disclosure.

As shown in FIG. 5, in an exemplary implementation mode, the printer has not started printing and the non-image-forming stage is located between the starting stage of the printer and the image forming stage of the printer. Continuously applying a first voltage or a second voltage to the developer roller of the printer in different time periods in the non-image-forming stage For example includes: continuously applying the first voltage in the first stage and a second voltage in the second stage. The ending time of the first stage may be the starting time of the second stage. For example, the first voltage can be −350V and the second voltage may be −300V. The first voltage and the second voltage both have negative polarities and the absolute value of the first voltage is greater than the absolute value of the second voltage. The surface of the photosensitive drum also has a negative polarity and the absolute value of the surface potential of the photosensitive drum is greater than the absolute value of the first voltage. Thus, in the non-image-forming stage, the potential difference between the photosensitive element and the developer element may be reduced by increasing the absolute value of the voltage applied to the developer roller so as to reduce the amount of unusually charged developer transferred to the surface of the photosensitive drum from the surface of the developer roller and the generation of waste developer. Then the voltage is switched to the second voltage, so that it can be prevented that when the image forming device enters the image forming stage and after the surface of the photosensitive element is exposed, the potential difference between the surface of the exposure region of the photosensitive element and the developer element is large, so that a large amount of normally charged developer on the surface of the developer element is transferred to the surface of the photosensitive element and the printed image is deflection black in whole and poor in image quality.

In addition, as shown in FIG. 6, when the printer finishes image printing and is about to enter the standby mode, the non-image-forming stage is located after the image forming stage of the printer. Continuously applying the first voltage or the second voltage to the developer roller in different time periods in the non-image-forming stage includes: continuously applying the second voltage in the second stage, and then continuously applying the first voltage in the first stage. The ending time of the second stage can be the starting time of the first stage. The first voltage may be −350V and the second voltage may be −300V. The variations of voltage and the potential difference between the printing parts, such as the developer roller and the like are similar to previous described embodiment, and the description will not repeated herein.

Similarly, as shown in FIG. 7, when the printer performs double-sided printing, the second voltage may be continuously applied to the developer roller in the first second-stage. Then the first voltage is continuously applied in the first stage, and then the second voltage is continuously applied in the second second-stage. The two second stages and one first stage form the non-image-forming stage. In an exemplary embodiment, the end time of the first second-stage may be the start time of the first stage, and the ending time of the first stage is the starting time of the second second-stage. The first voltage may still be −350V, the second voltage is −300V, and the first voltage and the second voltage have the same polarity.

Under the three different printing statuses of the printers, similar to the change of the voltage on the transfer roller, the non-image-forming stage of the developer roller is also divided into a first stage and a second stage. The first voltage and the second voltage are different in absolute value in the first stage and the second stage, so that a different first potential difference and a second potential difference are formed between the developer element and the photosensitive element. Thus, when the first voltage with a greater absolute value is applied to the developer roller, the generation of the waste powder in the non-image-forming stage is reduced. When the second voltage with a smaller absolute value is applied, it may be prevented that the image printed in the image forming stage is deflection black as a whole. It may also prevent the occurrence of abnormity under the extreme conditions such as low-temperature and low-humidity. The overall working status and the voltage change rule of the developer roller are similar to those in previously described embodiments, and the description will not repeated herein.

In this embodiment, the image forming method includes when the image forming device is in a non-image-forming stage, applying a voltage to the surface of the photosensitive element and the surface of the developer element of the image forming device to form an electric field. The applying of voltage of the image forming device includes two stages. In a first stage, a first potential difference is formed between the photosensitive element and the developer element. In a second stage, a second potential difference is formed between the photosensitive element and the developer element. When the developer used by the image forming device is a negatively charged developer, the direction of the first potential difference and the direction of the second potential difference are in a direction from the developer element to the photosensitive element. When the developer used by the image forming device is a positively charged developer, the direction of the first potential difference and the direction of the second potential difference are in a direction from the photosensitive element to the developer element. The absolute value of the first potential difference is less than the absolute value of the second potential difference. In this way, when the image forming device is in a non-image-forming stage, the potential difference between the photosensitive element and the developer element may be reduced. Thus, the amount of unusually charged developer transferred from the surface of the developer roller to the surface of the photosensitive drum is reduced. As such, the waste of the developer generated when the image forming device is in the non-image-forming stage is reduced so that the waste of the developer is effectively reduced. Therefore, the problem may be avoided that the image forming device or the paper will be contaminated when the waste developer generated in the image forming unit is too much to overflow the waste developer storage device of the image forming unit.

Embodiment 3

Figure 8:
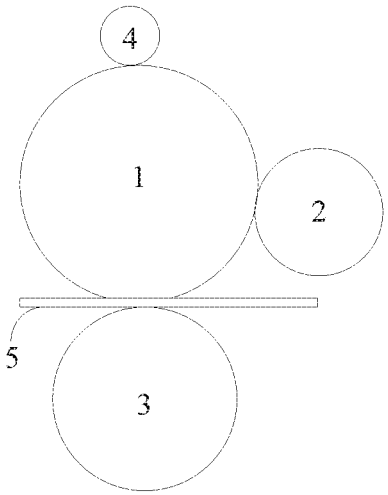
FIG. 8 is a schematic structural diagram of an image forming device according to disclosed embodiments of the present disclosure.

FIG. 8 is a schematic structural diagram of an image forming device according to embodiments of the present disclosure. As shown in FIG. 8, the image forming device provided in this embodiment may execute the image forming method in the previously described embodiments. The image forming device For example includes a voltage applying unit (not shown in the figure) and a transfer element. The voltage applying unit is electrically connected to the transfer element. The voltage applying unit is used for continuously applying a first voltage to the transfer element in a first stage in an image forming stage of the image forming device and continuously applying a second voltage to the transfer element in a second stage in a non-image-forming stage. The absolute value of the first voltage is greater than the second voltage, and the polarities of the first voltage and the second voltage are opposite to the polarity of the potential on the surface of the photosensitive element.

For example, the image forming device may include a photosensitive drum 1, a developer roller 2, a transfer roller 3, a charging roller 4, etc. The surface of the photosensitive drum 1 has a photosensitive coating, and the surfaces of the photosensitive drum 1 and the transfer roller 3 may carry electrostatic charges. The surface of the developer roller 2 is attached with developer which carries charges, and the transfer roller 3 is in elastic contact with the surface of the photosensitive drum 1.

When the image forming device of the present embodiment performs normally the image forming task, the general working process is as follows: when the surface of the photosensitive drum 1 rotates through the charging drum 4, the surface of the photosensitive drum 1 is uniformly distributed with negative charges, and after the photosensitive coating of the photosensitive drum 1 is subjected to illumination, the charge distribution on the surface of the photosensitive drum 1 may changed correspondingly; the developer roller 2 is in elastic contact with the surface of the photosensitive drum 1, so that the developer on the developer roller 2 may be transferred to the photosensitive drum 1 under the influence of an electric field between the photosensitive drum 1 and the developer roller 2, and then the developer on the photosensitive drum 1 is adsorbed onto the printing paper 5 under the influence of the electric field between the photosensitive drum 1 and the transfer roller 3 and the image forming process is completed.

Figure 9:
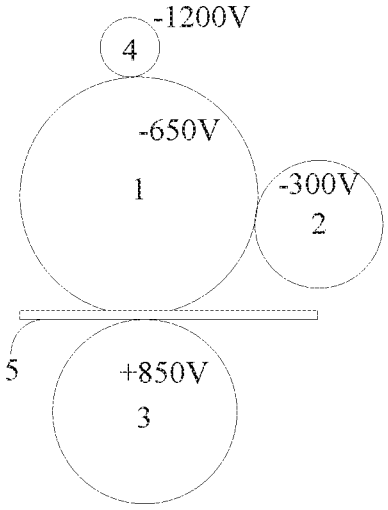
FIG. 9 is a schematic diagram of electric potential when a first voltage is applied to an image forming device according to disclosed embodiments of the present disclosure.

For example, the first voltage and the second voltage may be continuously applied to the transfer roller. FIG. 9 is a schematic diagram of the electric potential when the first voltage is applied to the image forming device according to embodiments of the present disclosure. As shown in FIG. 9, when the image forming device is in a non-image-forming stage, for example, when the printer is in a stage that the printer has just started yet without printing, a first voltage may be applied to the transfer roller 3. The voltage of the charging roller at this moment is −1200V and the voltage applied to the transfer roller 3 is +850V. The potential of surface of the photosensitive drum is about −650V after passing through the charging roller and the voltage of the developer roller is about −300V. At this moment, the potential difference between the surface of the photosensitive drum and the developer roller is small so that the surface of the developer roller 3 only has a very small amount of the developer charged unusually may be absorbed by the photosensitive drum 1 to form waste developer.

Figure 10:
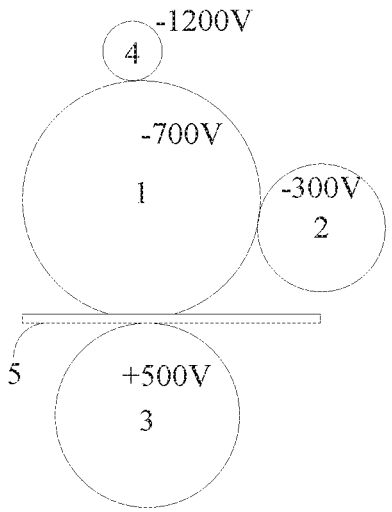
FIG. 10 is a schematic diagram of electric potential when a second voltage is applied to an image forming device according to disclosed embodiments of the present disclosure.
Figure 11:
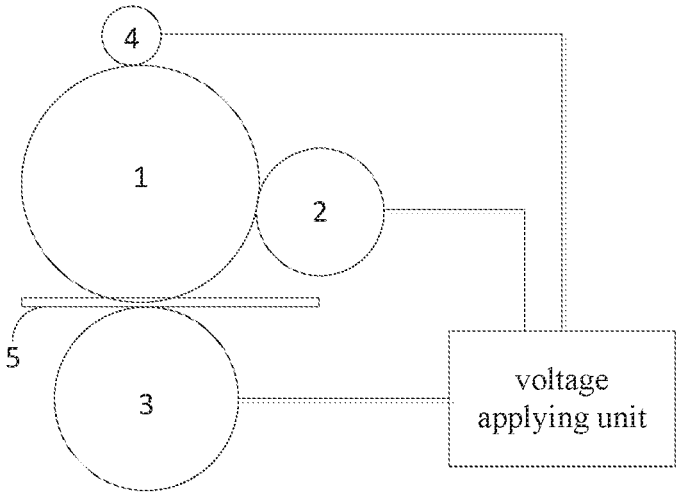
FIG. 11 is a schematic diagram of electric potential when a second voltage is applied to an image forming device by a voltage applying unit according to disclosed embodiments of the present disclosure.
Figure 12A:
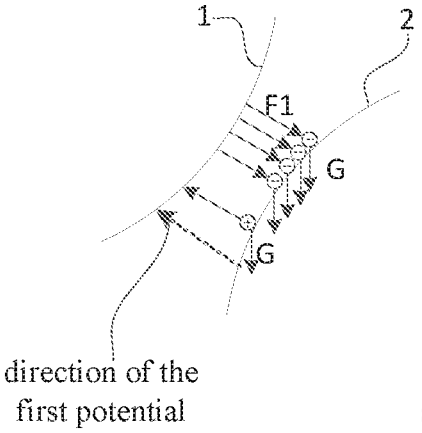
FIGS. 12A and 12B are schematic diagrams of the directions of the first potential and the second potential when the developer used by the developer element is a negatively charged developer, respectively, according to disclosed embodiments of the present disclosure.
Figure 12B:
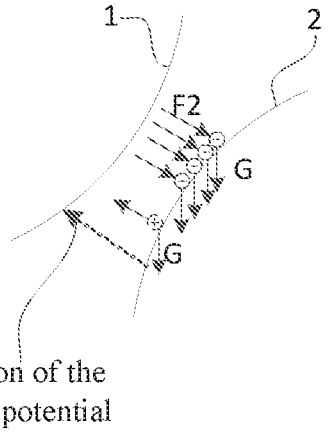
Figure 12C:
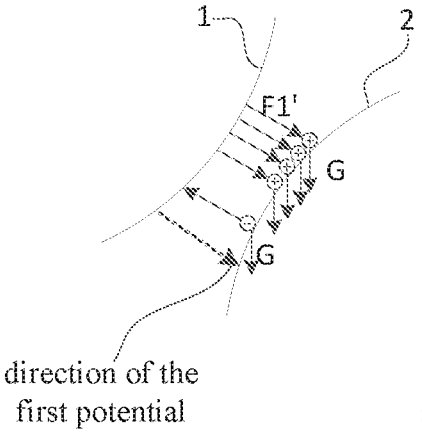
FIGS. 12C and 12D are schematic diagrams of the directions of the first potential and the second potential when the developer used by the developer element is a positively charged developer, respectively, according to disclosed embodiments of the present disclosure.
Figure 12D:
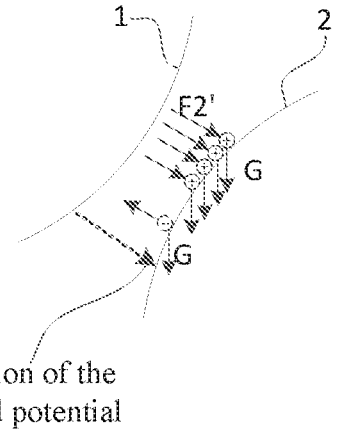

FIG. 10 is a schematic diagram of the electric potential when the second voltage is applied to the image forming device according to embodiments of the present disclosure. As shown in FIG. 10, when the image forming device is still in a non-image-forming stage and is about to enter the image forming stage, a second voltage is applied to the transfer roller, for example, a voltage of +500V is applied to the transfer roller, the potential of the surface of the photosensitive drum after being charged by the charging roller is about −700V and the voltage of the developer roller is about −300V. At this moment, the potential difference between the photosensitive drum and the developer roller is less than the potential difference between the photosensitive drum and the developer roller when the first voltage is applied to the transfer roller, so that normally charged developer transferred from the surface of the developer roller to the surface of the photosensitive drum may be reduced and the problem can be avoided that the printed image is deflection black as a whole.

Comparing to a voltage of +500V being continuously applied to the transfer roller, due to the fact that the absolute value of the voltage applied to the transfer roller is larger, the potential of the photosensitive drum in contact with the transfer roller is changed, so that the potential difference between the surface of the photosensitive drum and the developer roller is small and the generation of the waste developer is remarkably reduced. According to the test, the waste developer generated when the voltage of +850V is applied all the time in the non-image-forming stage can be reduced by about 25% than when a +500V voltage is applied all the time in the non-image-forming stage. Therefore, a first voltage (+850V) is applied to the transfer roller in a first stage of the non-image-forming stage and a second voltage (+500V) is applied to the transfer roller in a second stage in the non-image-forming stage can reduce the waste developer generated in the non-image-forming stage compared to the second voltage is applied to the transfer roller by the voltage applying unit in the whole non-image-forming stage.

In this embodiment, the image forming device For example includes a voltage applying unit and a transfer element. The voltage applying unit and the transfer element are electrically connected. The voltage applying unit is used for continuously applying a first voltage to the transfer element in a first stage in a non-image-forming stage of the image forming device. A second voltage is applied to the transfer element in a second stage in the non-image-forming stage. The absolute value of the first voltage is greater than that of the second voltage and the polarities of the first voltage and the second voltage are opposite to the polarity of the potential on the surface of the photosensitive element. In this way, the potential difference between the developer roller and the photosensitive drum may be decreased when the image forming device is in a non-image-forming stage, and the amount of unusually charged developer transferred from the surface of the developer roller to the surface of the photosensitive drum is reduced, so that the waste developer generated when the image forming device is in the non-image-forming stage is reduced and the waster of the developer is effectively reduced. Therefore, the problem may be avoided that the image forming device or the paper will be contaminated when the waste developer generated in the image forming unit is too much to overflow the waste developer storage device of the image forming unit.

Embodiment 4

Another image forming device also provided in this embodiment may execute the image forming method in the previously described embodiments. The image forming device in this embodiment For example includes a voltage applying unit and a developer element. The voltage applying unit is electrically connected to the developer element. The voltage applying unit is used for continuously applying a first voltage to the developer element in a first stage in an image forming stage of the image forming device and continuously applying a second voltage to the developer element in a second stage in a non-image-forming stage. The absolute value of the first voltage is greater than that of the second voltage, and the polarities of the first voltage and the second voltage are same as the polarity of the potential on the surface of the photosensitive element. The surface of developer element of the image forming device may maintain an elastic contact with the surface of the photosensitive element, such as a photosensitive drum.

The structure and the specific working principle of the image forming device of the embodiment are similar to those of the image forming device of the previous embodiment, and the description will not be repeated herein.

In this embodiment, the image forming device For example includes a voltage applying unit and a developer element. The voltage applying unit and the developer element are electrically connected. The voltage applying unit is used for continuously applying a first voltage to the developer element in a first stage in a non-image-forming stage of the image forming device. A second voltage is applied to the developer element in a second stage in the non-image-forming stage. The absolute value of the first voltage is greater than that of the second voltage and the polarities of the first voltage and the second voltage are same as the polarity of the potential on the surface of the photosensitive element. In this way, the potential difference between the developer roller and the photosensitive drum may be decreased when the image forming device is in a non-image-forming stage, and the amount of unusually charged carbon developer transferred from the surface of the developer roller to the surface of the photosensitive drum is reduced, so that the waste developer generated when the image forming device is in the non-image-forming stage is reduced and the waster of the developer is effectively reduced. Therefore, the problem may be avoided that the image forming device or the paper will be contaminated when the waste developer generated in the image forming unit is too much to overflow the waste developer storage device of the image forming unit.

One of ordinary skill in the art will appreciate that all or part of the steps of the embodiments of the above method may be completed through hardware related to program instructions. The program instructions may be stored in a computer readable storage medium. When the program is executed, the steps included in the above method embodiments are executed. The storage medium includes: a ROM, a RAM, a magnetic disk, an optical disk, or other media capable of storing program instructions.

The image forming method and the image forming device of the present disclosure have the following technical benefits.

Firstly, when the developer used by the image forming device is a negatively charged developer, a direction of the first potential difference and a direction of the second potential difference are in a direction from the developer element to the photosensitive element. Thus, a large amount of the developer with negative charges under the influence of the electric field will not be transferred to the surface of the photosensitive element and be retained on the surface of the developer element. Only a small portion of the small amount of the positively charged developer or impurity may be transferred to the surface of the photosensitive element because a first potential difference which has an absolute value less than that of the second potential difference exists. Similarly, when the developer used by the image forming device is a positively charged developer, a large amount of positive charges are also retained on the surface of the developer element, and a small amount of the negatively charged developer or impurity is transferred to the surface of the photosensitive element. Therefore, cleaning the surface of the photosensitive element in the non-image-forming stage may generate less waste developer.

Secondly, when the printer enters the image forming stage after applying voltages to the developer element and the photosensitive element of the image forming device so that a second potential difference with an absolute value that is large, due to the presence of the second potential difference with an absolute value that is larger (respect to the first potential difference), the potential of the photosensitive element may be closer to the voltage status of the photosensitive element in the image forming stage. Thus, it can be prevented that when the image forming device enters the image forming stage, after the surface of the photosensitive element is exposed, the potential difference between the surface of the exposure region of the photosensitive element and the developer element is large, so that a large amount of normally charged developer on the surface of the developer element is transferred to the surface of the photosensitive element, and the printed image is deflection black as a whole and the image quality is poor.

Thirdly, after the image forming device completes the image forming stage, voltages are applied on the photosensitive element and the developer element of the image forming device to form the second potential difference between the photosensitive element and the developer element. After the photosensitive element operates for one circle, voltages are applied to form the first potential difference, which has a smaller absolute value respect to the second potential difference, between the photosensitive element and the developer element. Thus, the transfer of the unusually charged developer from the surface of the developer element to the surface of the photosensitive element is reduced so that the generation of waste developer is reduced.

Therefore, the purpose of reducing the waste developer can be achieved while the image quality in the developing stage is not influenced.

Finally, it should be noted that the above embodiments are only used to illustrate the technical solutions of the present disclosure and are not limited thereto. Although the present disclosure has been described in detail with reference to the above embodiments, it should be understood by those of ordinary skill in the art that the technical scheme described in the embodiments can still be modified, some or all of the technical features can be equivalently replaced, and the modification or replacement does not make the essence of the corresponding technical solution deviate from the scope of the technical solutions of the embodiments of the present disclosure.

What is claimed is:

1. An image forming method, comprising:

when an image forming device is in a non-image-forming stage, applying voltages to a surface of a photosensitive element and a surface of a developer element of the image forming device to form an electric field, wherein applying the voltages comprises:

forming a first potential difference between the photosensitive element and the developer element in a first stage, and forming a second potential difference between the photosensitive element and the developer element in a second stage, wherein:

when a developer used by the developer element is a negatively charged developer, a direction of the first potential difference and a direction of the second potential difference are in a direction from the developer element to the photosensitive element, when the developer used by the developer element is a positively charged developer, the direction of the first potential difference and the direction of the second potential difference are in a direction from the photosensitive element to the developer element, an absolute value of the first potential difference is less than an absolute value of the second potential difference, and when the image forming device is in an image forming stage, a potential difference formed between the photosensitive element and the developer element is equal to the second potential difference.

2. The image forming method according to claim 1, wherein:

when the non-image-forming stage includes one second stage, forming the first potential difference in the first stage is earlier than forming the second potential difference in the second stage, and after the second stage, the image forming device is in an image forming stage, or when the non-image-forming stage includes one second stage, forming the first potential difference in the first stage is later than forming the second potential difference in the second stage, and before the second stage, the image forming device is in the image forming stage.

3. The image forming method according to claim 1, wherein:

when the non-image-forming stage includes two second stages, including a first second stage and a second second stage, a time point for forming the first potential difference in the first stage is between a time point for forming the second potential difference in the first second stage and a time point for forming the second potential difference in the second second stage, and after the second second stage, the image forming device is in an image forming stage.

4. The image forming method according to claim 1, wherein applying voltages to the surface of the photosensitive element and the surface of the developer element of the image forming device to form the electric field comprises:

in the first stage, applying a first voltage to a transfer element, and in the second stage, applying a second voltage to the transfer element, wherein an absolute value of the first voltage is greater than an absolute value of the second voltage, and a polarity of the first voltage and a polarity of the second voltage are opposite to a polarity of a potential of the surface of the photosensitive element.

5. The image forming method according to claim 1, wherein applying voltages to the surface of the photosensitive element and the surface of the developer element of the image forming device to form the electric field comprises:

in the first stage, applying a first voltage to the developer element, and in the second stage, applying a second voltage to the developer element, wherein an absolute value of the first voltage is greater than an absolute value of the second voltage, and a polarity of the first voltage and a polarity of the second voltage are same as a polarity of a potential of the surface of the photosensitive element.

6. The image forming method according to claim 4, wherein:

a duration of applying the second voltage is greater than or equal to a time period for the photosensitive element to rotate by one circle.

7. The image forming method according to claim 5, wherein:

a duration of applying the second voltage is greater than or equal to a time period for the photosensitive element to rotate by one circle.

8. An image forming device, comprising:

a photosensitive element;

a developer element, wherein:

in a non-image-forming stage, the photosensitive element and the developer element are configured to have an electric field there-between, wherein in a first stage of the non-image-forming stage, a first potential difference is formed between the photosensitive element and the developer element; in a second stage of the non-image-forming stage, a second potential difference is formed between the photosensitive element and the developer element, and an absolute value of the first potential difference is less than an absolute value of the second potential difference, when the developer element uses a negatively charged developer, a direction of the first potential difference and a direction of the second potential difference are in a direction from the developer element to the photosensitive element, and when the developer element uses a positively charged developer, the direction of the first potential difference and the direction of the second potential difference are in a direction from the photosensitive element to the developer element; and when the image forming device is in an image forming stage, a potential difference formed between the photosensitive element and the developer element is equal to the second potential difference; and a voltage applying unit, electrically connected to the developer element and configured to:

continuously apply a first voltage to the developer element in the first stage of the non-image-forming stage, and continuously apply a second voltage to the developer element in the second stage of the non-image-forming stage, and an absolute value of the first voltage is greater than an absolute value of the second voltage, and a polarity of the first voltage and a polarity of the second voltage are same as a polarity of a potential on the surface of the photosensitive element.

9. The image forming device according to claim 8, wherein the surface of the developer element maintains an elastic contact with the surface of the photosensitive element.

10. The image forming device according to claim 8, wherein:

when the non-image-forming stage includes one second stage, forming the first potential difference in the first stage is earlier than forming the second potential difference in the second stage, and after the second stage, the image forming device is in an image forming stage, or when the non-image-forming stage includes one second stage, forming the first potential difference in the first stage is later than forming the second potential difference in the second stage, and before the second stage, the image forming device is in the image forming stage.

11. The image forming device according to claim 8, wherein:

when the non-image-forming stage includes two second stages, including a first second stage and a second second stage, a time point for forming the first potential difference in the first stage is between a time point for forming the second potential difference in the first second stage and a time point for forming the second potential difference in the second second stage, and after the second second stage, the image forming device is in an image forming stage.

12. The image forming device according to claim 8, wherein applying voltages to the surface of the photosensitive element and the surface of the developer element of the image forming device to form the electric field comprises:

in the first stage, applying a first voltage to a transfer element, and in the second stage, applying a second voltage to the transfer element.

13. The image forming device according to claim 12, wherein:

a duration of the second voltage is greater than or equal to a time period for the photosensitive element to rotate by one circle.

14. An image forming device, comprising:

a photosensitive element;

a transfer element;

a developer element, wherein:

in a non-image-forming stage, the photosensitive element and the developer element are configured to have an electric field there-between, wherein in a first stage of the non-image-forming stage, a first potential difference is formed between the photosensitive element and the developer element; in a second stage of the non-image-forming stage, a second potential difference is formed between the photosensitive element and the developer element, and an absolute value of the first potential difference is less than an absolute value of the second potential difference, when the developer element uses a negatively charged developer, a direction of the first potential difference and a direction of the second potential difference are in a direction from the developer element to the photosensitive element, and when the developer element uses a positively charged developer, the direction of the first potential difference and the direction of the second potential difference are in a direction from the photosensitive element to the developer element; and a voltage applying unit, electrically connected to the transfer element and configured to:

continuously apply a first voltage to the transfer element in the first stage of the non-image-forming stage, and continuously apply a second voltage to the transfer element in the second stage of the non-image-forming stage, and an absolute value of the first voltage is greater than an absolute value of the second voltage, and a polarity of the first voltage and a polarity of the second voltage are opposite to a polarity of a potential on the surface of the photosensitive element.

15. The image forming device according to claim 14, wherein the surface of the developer element maintains an elastic contact with the surface of the photosensitive element.

16. The image forming device according to claim 14, wherein:

when the non-image-forming stage includes one second stage, forming the first potential difference in the first stage is earlier than forming the second potential difference in the second stage, and after the second stage, the image forming device is in an image forming stage, or when the non-image-forming stage includes one second stage, forming the first potential difference in the first stage is later than forming the second potential difference in the second stage, and before the second stage, the image forming device is in the image forming stage.

17. The image forming device according to claim 14, wherein:

when the non-image-forming stage includes two second stages, including a first second stage and a second second stage, a time point for forming the first potential difference in the first stage is between a time point for forming the second potential difference in the first second stage and a time point for forming the second potential difference in the second second stage, and after the second second stage, the image forming device is in an image forming stage.

18. The image forming device according to claim 14, wherein:

when the image forming device is in an image forming stage, a potential difference formed between the photosensitive element and the developer element is equal to the second potential difference.

* * * * *